US005624274A

United States Patent [19]

Lin

[11] Patent Number: 5,624,274

[45] Date of Patent: Apr. 29, 1997

[54] TELEPHONE CONNECTOR WITH CONTACT PROTECTION BLOCK

[75] Inventor: Mike H. Lin, Cerritos, Calif.

[73] Assignee: International Connectors and Cable Corporation, Cerritos, Calif.

[21] Appl. No.: 551,839

[22] Filed: Nov. 7, 1995

[51] Int. Cl.[6] ..... H01R 23/02

[52] U.S. Cl. ..... 439/417; 439/676

[58] Field of Search ..... 439/404, 417, 439/676

[56] References Cited

U.S. PATENT DOCUMENTS

| | | | |
|---|---|---|---|
| 4,261,633 | 4/1981 | Abernethy | 439/405 |
| 4,657,330 | 4/1987 | Levy | 439/402 |
| 4,820,192 | 4/1989 | Denkmann et al. | 439/404 |
| 4,865,564 | 9/1989 | Denkmann et al. | 439/404 |
| 4,975,078 | 12/1990 | Stroede et al. | 439/405 |
| 5,091,826 | 2/1992 | Arnett et al. | 439/404 |
| 5,096,442 | 3/1992 | Arnett et al. | 439/404 |
| 5,118,310 | 6/1992 | Stroede et al. | 439/676 |
| 5,145,401 | 9/1992 | Archer | 439/676 |
| 5,169,346 | 12/1992 | Johnston | 439/676 |
| 5,228,872 | 7/1993 | Liu | 439/404 |
| 5,403,200 | 4/1995 | Chen | 439/676 |
| 5,498,172 | 3/1996 | Noda | 439/404 |
| 5,501,617 | 3/1996 | Arneet | 439/417 |

*Primary Examiner*—P. Austin Bradley
*Assistant Examiner*—Jill Demello
*Attorney, Agent, or Firm*—Pretty, Schroeder, Brueggemann & Clark

[57] ABSTRACT

A jack assembly for termination of a plurality of telephone wires includes a housing defining an opening for receiving a standard telephone plug. A contact pin carrier is mounted to the housing and supports eight contact pins having insulation displacement portions. The contact pin carrier further includes a contact protection block formed around the insulation displacement portions of the eight contact pins. A termination cap has telephone wire engagement portions that secure the telephone wires in conductive engagement with the insulation displacement portions of the contact pins. The termination cap further includes two end walls, each disposed in opposed alignment with a respective side wall of the contact protection block. The side walls of the termination cap may be interlocked to the contact protection block to retain the termination cap in an assembled position.

10 Claims, 12 Drawing Sheets

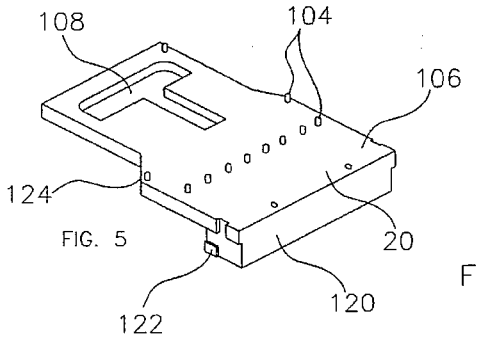
FIG. 5
FIG. 5
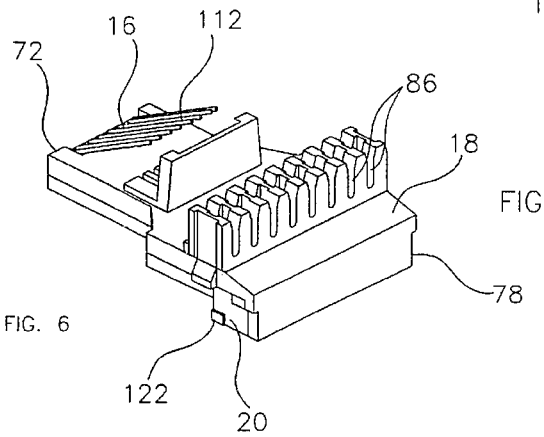
FIG. 6
FIG. 6
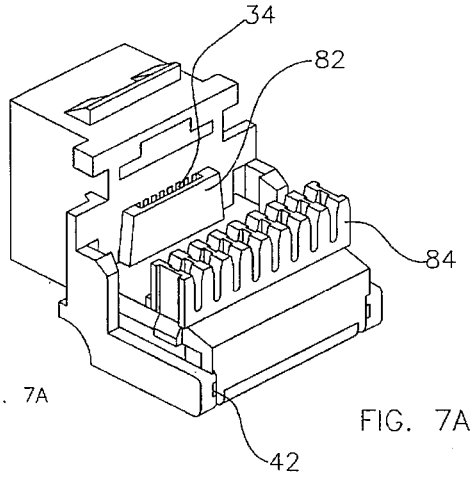
FIG. 7A
FIG. 7A
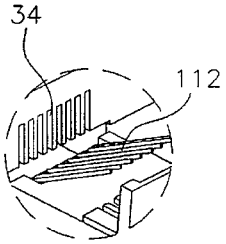
FIG. 7B
FIG. 7B

TELEPHONE CONNECTOR WITH CONTACT PROTECTION BLOCK

This invention relates to electrical connectors and, in particular, to a modular jack assembly for terminating individual wires of a telephone cable.

BACKGROUND OF THE INVENTION

A universal plug and jack configuration for telephone wiring has been selected for the national standard telephone interconnect system. The universal jacks and plugs are also incorporated into data processing and data transmitting equipment, as well as consumer and business machines, adapting such equipment for interconnection over telephone communication networks.

Many different designs of field installable modular telephone connectors have been developed. The desirable characteristics of a field installable telephone connector include a minimal size, ease of assembly and reliable termination of the connector to telephone wires.

Modular telephone connectors typically include a plurality of interlocking parts including a housing that defines a standard telephone jack, a contact carrier that carries and positions a plurality of insulation displacement contacts for termination to a plurality of wires and a termination cap that positions individual wires for termination within each respective insulation displacement contact. The housing and contact carrier can be formed integrally but are usually manufactured separately and preassembled to form a housing/wire carrier unit that presents the insulation displacement contacts for receipt of the telephone wires when the termination cap is assembled to the housing and contact carrier.

With reference to FIG. 16, a prior art telephone connector is shown having an assembled housing/contact carrier 2 and a termination cap 4. Eight contact pins 6 are arranged in a single row. The termination cap has a corresponding number of slots 8 that cooperate with the pins 6 to terminate up to eight telephone wires (not shown) in the connector. The termination cap is secured to the housing by interlocking tabs and notches located on the termination cap and housing sidewalls, respectively. While this connector has worked quite well, it does have its disadvantages. For example, the contact pins 6 may be damaged or bent either before or during assembly. In addition, because termination tools may damage the exposed contacts, termination should be done by hand, which results in inefficiencies and excessive waste until the mechanic develops adequate experience and technique.

Another type of telephone connector is described in U.S. Pat. No. 4,657,330 to Levy, incorporated herein by reference. This connector includes a housing 40, a contact carrier 50 and a termination cap 30 (see FIGS. 3, 7 and 11). Latches 44 on the housing engaged detents 46 on the termination cap to secure telephone wires to the connector. The contact pins are located closely adjacent a rear surface of the housing, which reduces the possibility of damage to them. The close proximity of the contact pins to the rear surface of the housing, however, requires the telephone wires to be cut flush with the surface 38 of the termination cap before assembly and makes it particularly difficult, if not impossible, to daisy chain telephone connectors together. There is also insufficient room between the contact pins and the housing to permit use of a termination tool. In addition, the latching mechanism has its disadvantages. The latches 44 are spaced from the contacts 52. Thus, the front of the termination cap 30 may tilt upward when the back of the cap is pushed down to engage the latches. To overcome this problem, another latching mechanism (e.g., a notch) may be located at the top, front surface of the termination cap (see FIG. 3) to engage the housing, but this requires precise alignment of the front and back latches to prevent faulty termination.

Another type of telephone connector is described in U.S. Pat. No. 5,403,200 to Chen, incorporated herein by reference. This connector includes a contact carrier 5 having a block 51 into which the contact pins 40 are inserted. The block protects the pins from damage, but no method of securing the caps to the jack assembly is described. Furthermore, many telephone connectors must be received in an opening having a standard width. With this connector, the termination caps cannot be placed fully around the contact protection block 51 without affecting the width of the connector. In addition, any securement of the cap to the assembly must be placed along the block's front or back walls and is subject to dislodgment whenever a telephone wire is pulled or jerked.

In view of the above, it should be appreciated that there is still a need for a telephone connector that protects the contact pins from damage, but which also permits easy and effective termination of telephone wires either manually or with the use of a termination tool.

SUMMARY OF THE INVENTION

The present invention is embodied in a telephone connector having a jack assembly for termination of telephone wires. Contact pins on the jack assembly are protected from damage and termination may be accomplished by using a standard termination tool or manually with a termination cap. In either case, termination is readily accomplished with ease, efficiency and accuracy.

The jack assembly of the present invention includes a housing having a front surface defining an opening for receiving a standard telephone plug. A contact pin carrier is mounted to the housing and supports eight contact pins which each have insulation displacement portions disposed rearwardly of the front surface of the housing and arranged upwardly in a single row transverse to the front surface opening. The contact pin carrier further includes a contact protection block that defines eight slots for receiving and guiding eight telephone wires into conductive engagement with the insulation displacement portions of the contact pins. A termination cap having telephone wire engagement portions that secure the telephone wires into conductive engagement with the insulation displacement portions of the contact pins may be assembled over the contact protection block. Means are provided for retaining the termination cap in an assembled position.

A feature of the present invention is that the contact protection block is formed around the insulation displacement portions of the eight contact pins and, in particular, has two side surfaces, one at each end of the single row of insulation displacement portions. An advantage of the contact protection block is that it prevents damage to the contact pins both prior to and during assembly. In addition, the contact protection block may be configured to be compatible with a standard termination tool, such as a punchdown tool, which ensures proper termination of telephone wires the first time and every time. Use of the invention with a punchdown tool is also more efficient and accurate than terminating by hand and is faster.

Another feature of the present invention is that the termination cap may be provided with two end walls, each disposed in opposed alignment with a respective sidewall of the contact protection block. This permits the termination cap to be placed fully around the contact protection block. An advantage of this feature is that the termination cap may be secured along its sides away from the terminated telephone wires, providing a stronger means for locking the cap in place. In addition, the width of the jack assembly is not increased, thus permitting it to be used with face plates and patch panels having standard width openings.

A further feature of the present invention is that the end walls of the termination cap and the sides of the contact protection block may be provided with latches and/or notches to secure the cap directly to the contact pin carrier. An advantage of this feature is that the force used to latch the assembly and the force used to manually terminate the telephone wires may be aligned and applied simultaneously to the termination cap from directly above the contact protection block. This prevents tilting of the termination cap during assembly and subsequent faulty terminations, which could otherwise occur if the latching mechanism and contact pins were spaced apart (see, for example, U.S. Pat. No. 4,657,330).

Another feature of the present invention is that the sides of the contact protection block may be provided with channels to guide the termination cap during assembly. The front of the termination cap may also be provided with guide bars that cooperate with channels in the housing to further guide the termination cap and to prevent the termination cap from shifting position after assembly.

Yet another feature of the present invention is that the termination cap may be provided with wire security slots having small tabs that serve to guide and organize the telephone wires, provide strain relief, prevent the wires from being bent at too great an angle and reduce the likelihood that the wires will come out of the slots after installation.

Other features and advantages of the present invention will become apparent from the following description of the preferred embodiments, taken in conjunction with the accompanying drawings, which illustrate, by way of example, the principles of the invention.

BRIEF DESCRIPTION OF THE DRAWINGS

FIG. 5 is a perspective view of a bottom insert of the jack assembly according to the present invention.

FIG. 6 is a perspective view of an assembled contact pin carrier according to the present invention.

FIG. 7A is a perspective view of the housing and the contact pin carrier after assembly. FIG. 7B is a partial perspective view of the housing and contact pin carrier during a step of the assembly.

DETAILED DESCRIPTION OF THE PREFERRED EMBODIMENTS

Figure 1:
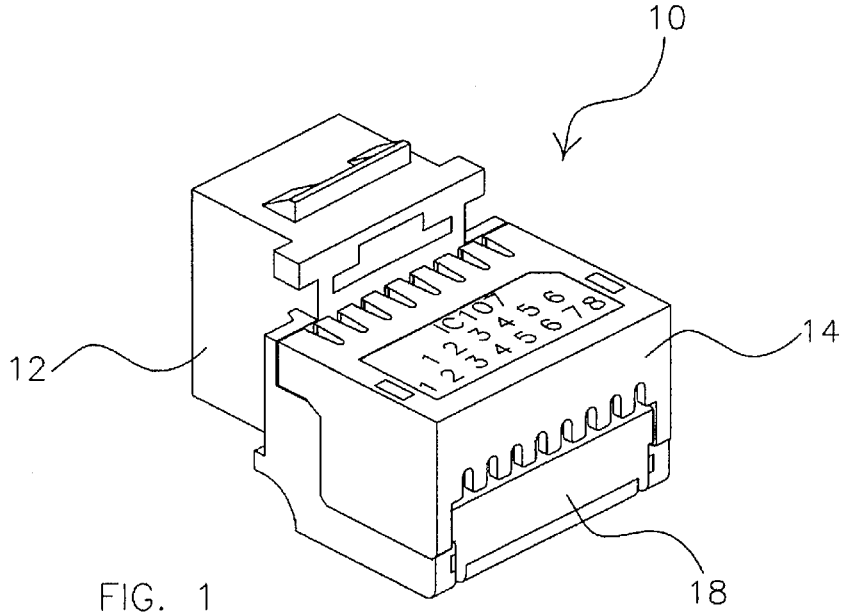
FIG. 1 is a perspective view of an assembled jack assembly according to the present invention.
Figure 16:
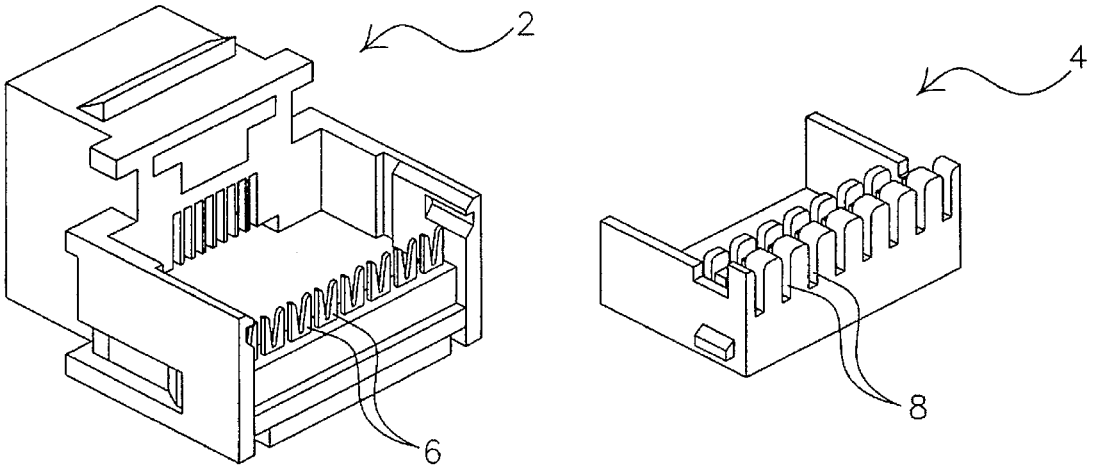
FIG. 16 is an exploded view of a prior art jack assembly.
Figure 2:
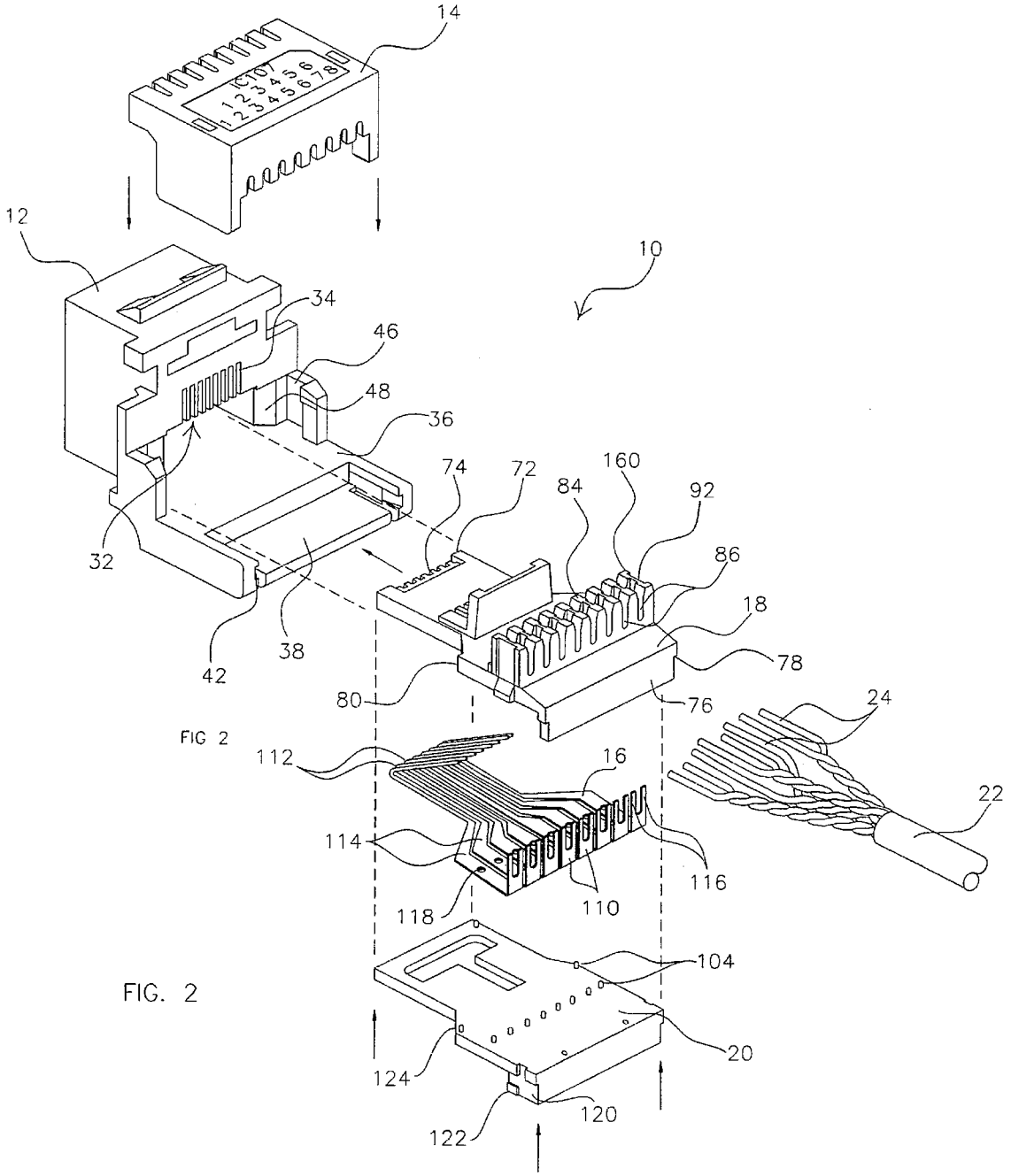
FIG. 2 is an exploded view of the jack assembly shown in FIG. 1.

A telephone connector in the form of a modular jack assembly 10 is shown in FIGS. 1 and 2. The jack assembly 10 includes a housing 12, a termination cap 14 and a contact pin carrier comprising eight contact pins 16 sandwiched between a top insert 18 and a bottom insert 20. A communication line, such as a telephone cable 22 having a plurality of telephone wires 24, may be terminated by the jack assembly as described below.

The eight contact pins 16 include eight upright insulation displacement portions 110 for receiving telephone wires, eight telephone plug contact portions 112 for connection to the wires of a standard modular telephone plug (not shown) and eight flat connector portions 114 connecting the insulation displacement portions and the plug contact portions, respectively. The insulation displacement portions each have forked edges 116 that can pierce the insulation of the telephone wire to make a contact. The connector portions each have a locator hole 118.

Figure 3A:
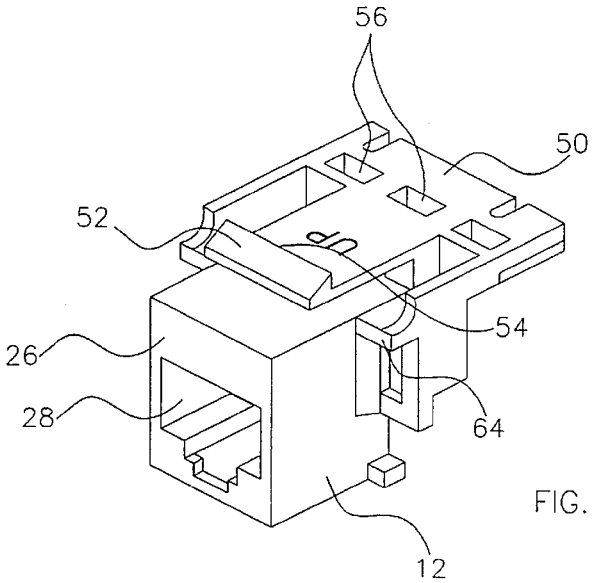
FIGS. 3A and 3B are front and rear perspective views, respectively, of a housing of the jack assembly according to the present invention.
Figure 3B:
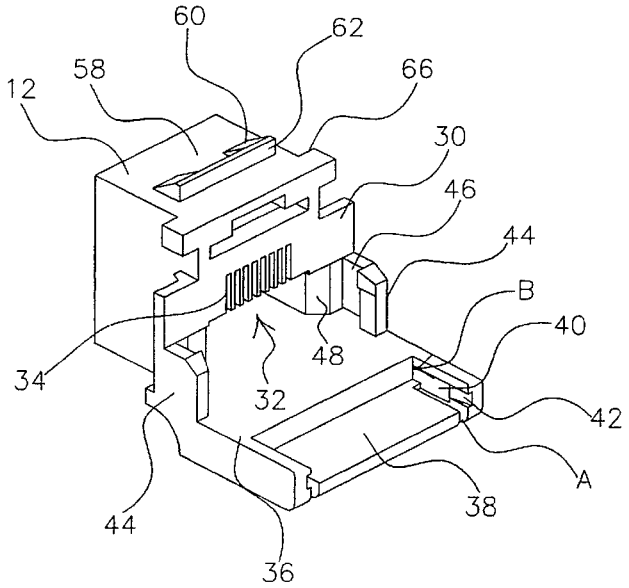
Figure 4A:
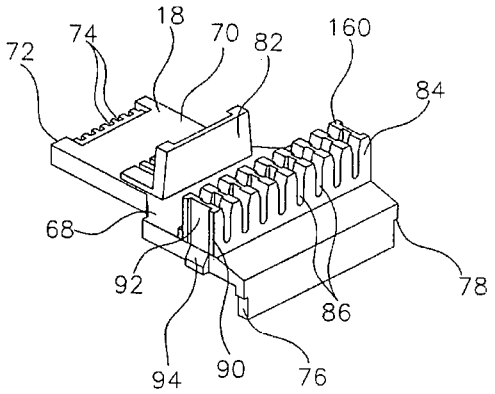
FIGS. 4A, 4B, 4C and 4D are perspective, top, bottom and side views, respectively, of a top insert of a contact pin carrier of the jack assembly according to the present invention.
Figure 4B:
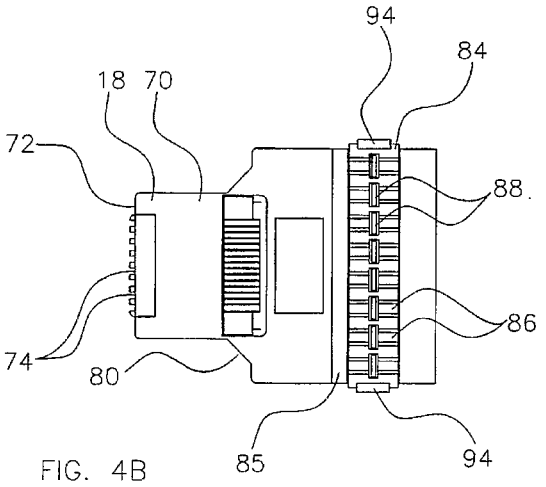
Figure 4C:
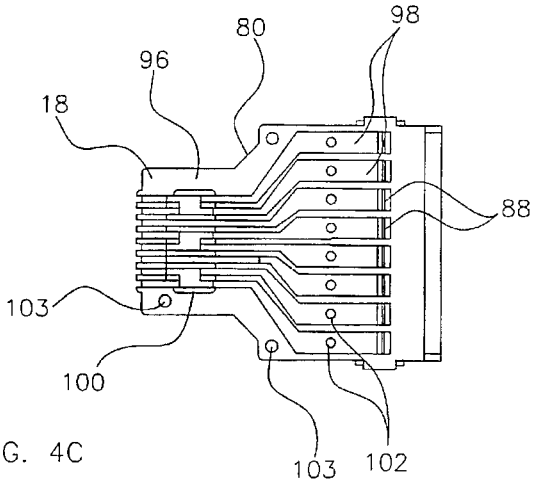
Figure 4D:
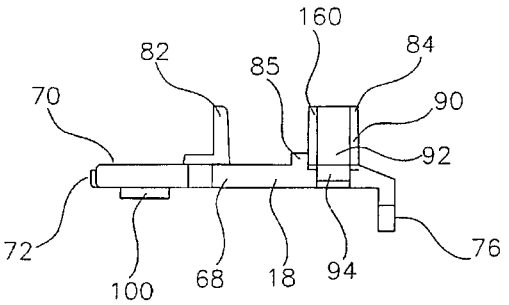

With reference to FIGS. 3A and 3B, the housing 12 has a front face 26 defining a telephone plug opening 28 of standard configuration for accepting a standard modular telephone plug (not shown). The telephone plug opening 28 extends through a back face 30 of the housing which further defines an insert opening 32 and a comb structure 34. Extending rearwardly of the back face 30 is a base 36 having a shelf 38. Sidewalls 40 of the shelf define insert slots 42. The shelf 38 is separated from sidewalls 40 at A and longitudinally extending bores B are provided completely through the base 36 to facilitate retraction of molds during molding of the housing. Preferably, the housing is made of Acrylonitrile-Butadiene-Styrene.

Adjacent the insert opening 32 of the housing are sidewalls 44, each having an inner surface that defines a vertically extending guide channel 46. Extending from the inner surface of each guide wall into the insert opening is a guide chamfer 48.

An upper surface 50 of the housing is provided with a cantilever latch 52 having a vertical bearing surface 54. The upper surface also includes a plurality of mounting holes 56. The bottom surface 58 of the housing includes a ramp 60 having a vertical wall 62. The ramp 60 may be a single piece or two parallel unconnected ramp pieces (not shown). Opposing the vertical bearing surface 54 and the vertical wall 62 are first and second depth restriction portions 64, 66 of the housing. The mounting holes 56, latch 52, ramp 60 and depth restriction portions 64, 66 facilitate installation and mounting of the housing to various types of boxes, plates and panels as will be described in more detail below with regard to FIGS. 12–14.

With reference to FIGS. 4A–4D, the top insert 18 includes a plate 68 having a top surface 70, a front face 72 defining eight notches 74 and a rear flange 76 extending downwardly from the plate 68. The rear flange includes projections at 78 extending outward from each end of the plate at the upper end of the rear flange. Toward the front end of the plate, the sides of the plate are chamfered at 80 to engage guide chamfer 48 of the housing 12 and thus act as a stop when the top insert 18 is assembled to the housing 12.

On the top surface 70 of the plate is an upwardly extending contact guard 82 and a contact protection block 84 also extending upwardly from the plate. The contact protection block extends transversely to the telephone plug opening. Along the front of the contact protection block 84 is a tool block 85 which provides a sturdy base for use with a wire termination tool. The contact protection block 84 defines eight longitudinally extending slots 86 for receiving eight telephone wires. At the midpoint of each slot, the slot may be widened to receive the insulation displacement portions 110 of the contact pins 16. The insulation displacement portions may enter the slots 86 through openings 88 in the plate 68. The slots are formed in part by intermediate walls that are located between and extend above the insulation displacement portions of adjacent contact pins. The contact protection block serves to protect the insulation displacement portions from damage and may be configured to be compatible with standard punchdown tools. End walls 90 of the contact protection block may be provided with vertically extending channels 92. At the base of each channel is a latch 94 that protrudes outwardly from each side of the contact protection block.

The bottom surface 96 of the plate defines contact receiving grooves 98 configured to closely receive the eight contact pins 16. A guide block 100 protrudes downward from the plate and has eight slots for receiving and guiding the connector portions 114 of the contact pins. Holes 102 are provided in the bottom surface and coincide with the locator holes 118 of the contact pins upon assembly of the contact pins to the top insert. Additional holes 103 are provided for assembly with the bottom insert. Preferably, the top insert is made from Polycarbonate.

With reference to FIG. 5, the bottom insert 20 has a plurality of posts 104 that cooperate with holes 102, 103 of the top insert to fix the top insert, bottom insert and contact pins together when assembled. An upper surface 106 of the bottom insert has a recessed area 108 for receiving the guide block 100 of the top insert. At the rear end of the bottom insert is a downwardly extending flange 120 having protruding locating portions 122 extending from the sides of the lower, front end of the flange. Like the top insert, the bottom insert also has sides that are chamfered at 124 to engage the guide chamfer 48 of the housing 12.

Assembly of the housing and contact pin carrier will now be described with reference to FIGS. 2, 6, 7A and 7B. The contact pins 16 are mounted to the top insert 18 by bending the telephone plug contact portions 112 around the notches 74 at the front face 72 of the top insert. The notches 74 organize and guide the pins to ensure proper location according to the national standard. The insulation displacement portions 110 of the contact pins are inserted from below into the slots 86 of the contact protection block. The connector portions 114 of the contact pins are inserted into the receiving grooves 98 and into the guide block 100 on the bottom surface of the top insert with the locator holes 118 of the contact pins aligned with the row of holes 102 (see FIG. 4C).

The bottom insert 20 is secured to the top insert 18 by aligning the posts 104 of the bottom insert with the holes 102, 103 of the top insert and squeezing the two pieces together with the contact pins sandwiched therebetween to form the contact pin carrier (FIG. 6). The contact pin carrier is then inserted into the opening 32 of the housing with care being taken to ensure that the telephone plug contact portions 112 of the contact pins 16 properly align with the comb structure 34 of the housing (FIG. 7B). During this phase of the assembly, the locator portions 122 of the bottom insert will be guided along the slots 42 of the housing and the flanges 76, 120 of the top and bottom inserts, respectively, will be guided along the shelf 38 of the housing. The projections 78 of the top insert are also guided along the top of the base 36 of the housing to assure that the insert assembly is properly installed. In addition, the guide chamfers 48 of the housing cooperate with the chamfered portions 80, 124 of the top and bottom inserts, respectively, to guide and stop the insert assembly in the proper location (FIG. 7A). Upon assembly, the contact guard 82 of the top insert is positioned directly in front of the comb structure 34 to protect the telephone plug contact portions 112 of the contact pins located within the comb structure from damage, e.g., from terminated telephone wires inserted through the contact protection block 84.

Figure 8A:
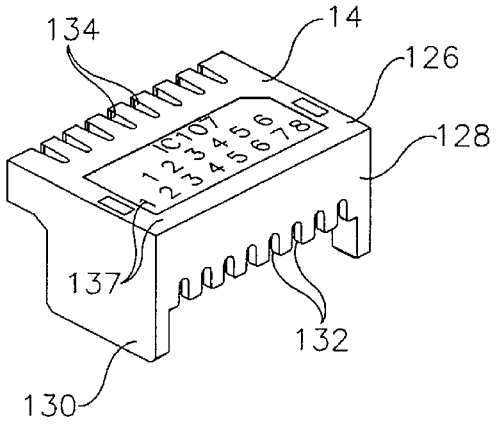
FIGS. 8A, 8B and 8C are perspective, bottom and side views, respectively, of a termination cap of the jack assembly according to the present invention.
Figure 8B:
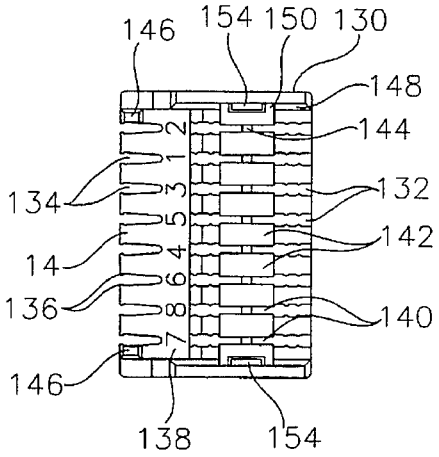
Figure 8C:
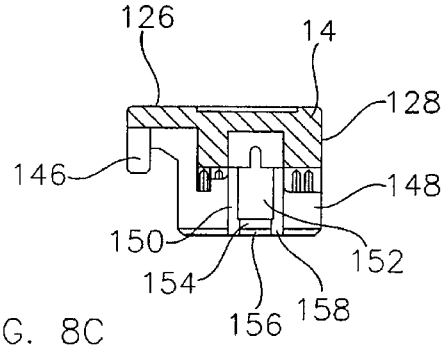

Next, with reference to FIGS. 8A–8C, the termination cap 14 includes a top surface 126, a rear surface 128 and two side walls 130. The rear surface is provided with a plurality of wire management slots 132. The width of the slots 132 is dimensioned to be slightly smaller than the diameter of the telephone wires, causing resistance to keep the wires in place and to provide strain relief. The slots also guide and separate the telephone wires entering the jack assembly.

Figure 9B:
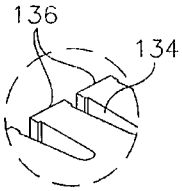
FIGS. 9B and 9C are perspective and top views, respectively, of a part of the wire security portion of the termination cap shown in FIG. 9A.
Figure 9C:
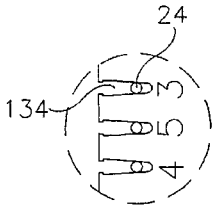

Similar to the rear surface, the top surface 126 of the termination cap has a plurality of wire channels 134 to guide and organize the wires and to provide strain relief. In the preferred embodiment, the wire channels 134 have small tabs 136 at their open ends, which reduce the likelihood that the telephone wires 24 will come out of the channels after installation (see FIGS. 9B and 9C). The top surface 126 may also be molded to provide a series of numbers 137 to correspond with the wire connections inside the jack assembly.

An inside surface 138 of the termination cap is provided with alternating terminating bars 140 and recesses 142. The terminating bars assist the cap in forcing telephone wires down to the proper depth inside the contact protection block of the contact pin carrier to ensure insulation displacement and proper contact with the contact pins. The recesses provide clearance for the top of the contact protection block 84. The termination bars 140 each also have a cutout 144 to provide clearance for the insulation displacement portions 110 of the contact pins. Extending down from the inside surface 138, adjacent each sidewall 130 are guide bars 146 that are configured to be closely received within the guiding channels 46 of the housing.

An inner surface 148 of each sidewall 130 includes a vertically extending channel 150 having a centrally located recess 152. At the base of the recess is an inwardly extending latch 154 having a ramp surface 156. Preferably, the latch 154 is located inside the channel 150, defining slots 158 on each side of the latch. The channel 150 and latch 154 of each sidewall are configured and located to cooperate with the channel 92 and latch 94 of each end wall of the contact protection block 84 to ensure interlocking engagement.

Figure 10A:
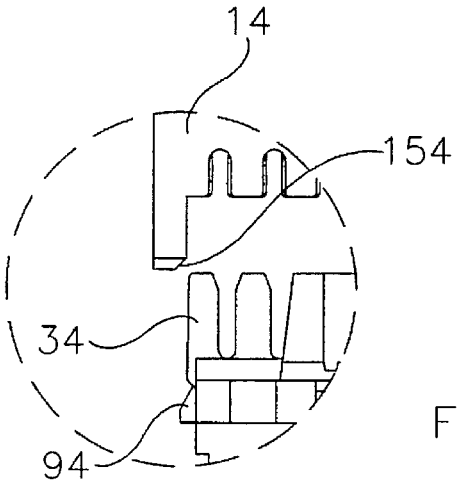
FIGS. 10A, 10B and 10C are successive rear views showing the assembly of the termination cap to the contact protector block of the contact pin carrier.
Figure 10B:
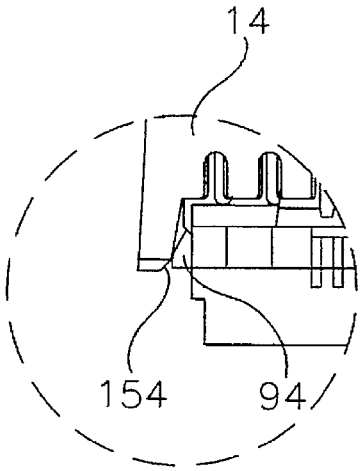
Figure 10C:
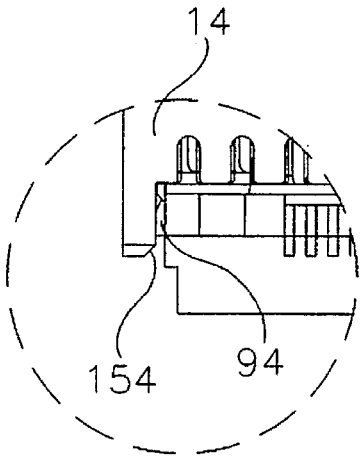

Assembly of the termination cap to the rest of the jack assembly will now be described with reference to FIGS. 2 and 10A–10C. The termination cap 14 is first aligned above the contact protection block 84 with the latches 154 of the termination cap engaged within the channels 92 of the contact protection block. Preferably, channel walls 160 of the channel 92 are located in the slots 158 of the termination cap (see FIGS. 4D and 8C). The termination cap is then guided down the channels 92 until the latches 154 engage the latches 94. Further downward movement of the termination cap causes the side walls 130 of the termination cap to deflect outwardly (FIG. 10B) until the latches 154 clear the bottom of the latches 94. The side walls of the termination cap then snap back to their original form with the latches 94 of the contact protection block retaining the termination cap in place (FIG. 10C). Care should also be taken during assembly to insert the guide bars 146 (see FIG. 8B and 8C) into the guide channels 46 of the housing. This further ensures that the termination cap is properly assembled.

Figure 9A:
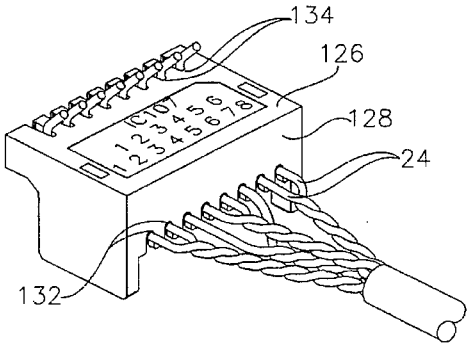
FIG. 9A is a perspective view of telephone wires assembled to the termination cap shown in FIG. 8A.

With reference now to FIG. 9A, manual termination of the telephone wires 24 through use of the termination cap will now be discussed. The telephone wires are inserted individually through the wire management slots 132 in the rear surface 128 of the termination cap. The wires are also inserted up through the wire channels 134 in the top surface 126 of the termination cap. Each telephone wire will pass over respective termination bars 140 on the inside surface 138 of the termination cap (FIG. 8B). Care should be taken to mount the telephone wires in proper alignment through the slots 132, over the termination bars 140 and through the channels 134. Wire termination is achieved by pushing the cap onto the contact protection block 84 of the contact pin carrier, as discussed above with regard to FIGS. 10A–10C. If desired, pliers may be used to generate the necessary force to cause the insulation displacement portions of the contact pins to cut through the insulation of the telephone wires and make proper contact.

Figure 11A:
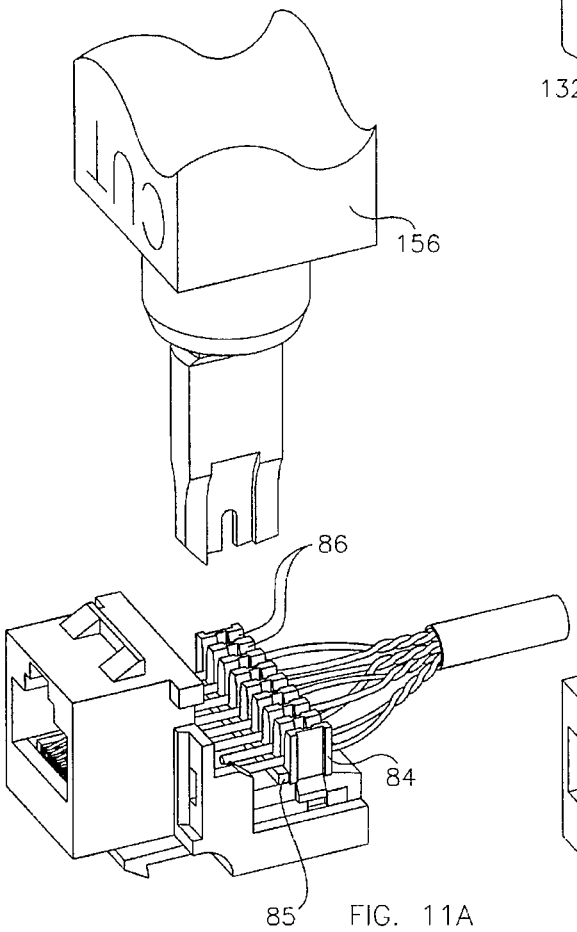
FIGS. 11A and 11B are successive perspective views showing the termination by a punchdown tool of telephone wires assembled to the jack assembly according to the present invention.
Figure 11B:
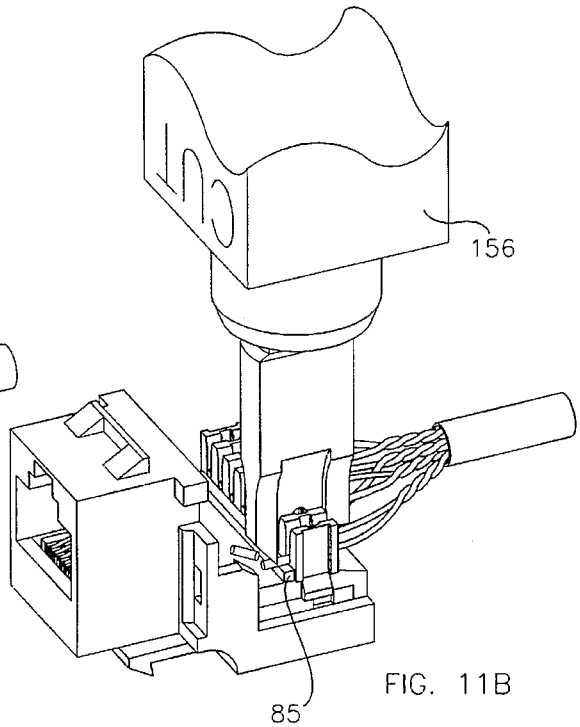

Alternatively, with reference to FIGS. 11A and 11B, termination may be achieved by using a punchdown tool 156. In this case, the telephone wires are inserted directly into the slots 86 of the contact protection block 84, then pushed down and simultaneously cut with the punchdown tool. The tool block 85 on the upper surface of the top insert serves as a sturdy base for cutting by the punchdown tool. After the telephone wires have been terminated, the termination cap may be assembled to the contact protection block, taking care to position the telephone wires into the proper slots 132 of the rear surface of the termination cap. In this instance, the termination cap serves to retain the telephone wires in place and to provide strain relief. The punchdown tool described herein is a standard tool in the industry and may be obtained from a number of sources. One example, is the line of universal impact tools manufactured by Harris Tools and distributed by International Connectors and Cable Corporation of Cerritos, Calif.

Figure 12:
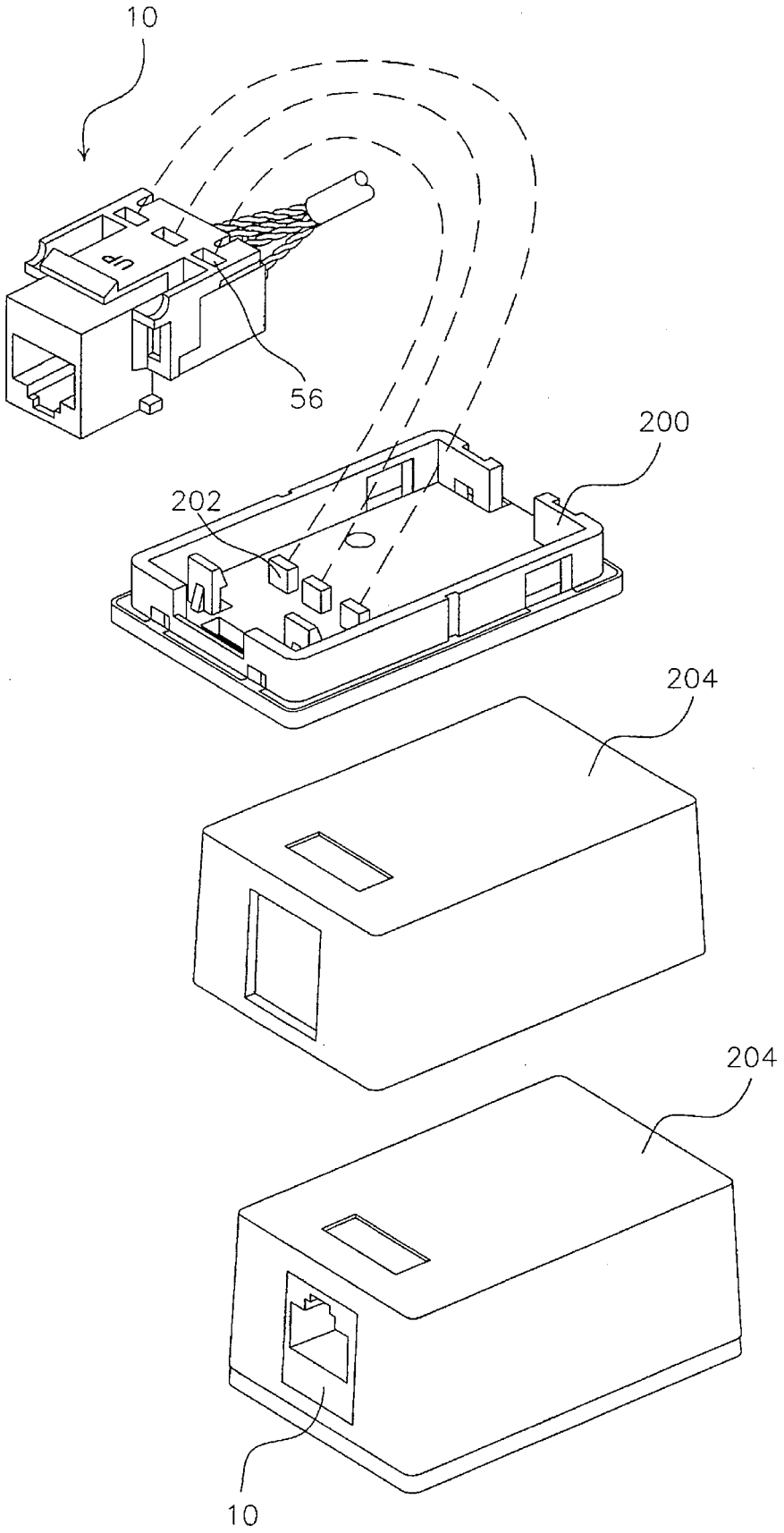
FIG. 12 is an exploded view of a surface mount installation of a jack assembly according to the present invention.

With reference to FIG. 12, the jack assembly 10 of the present invention may be assembled to a surface mount box base 200 by matching the mounting holes 56 of the housing to corresponding tabs 202 of the box base. A box cover 204 may then be secured to the base.

Figure 13A:
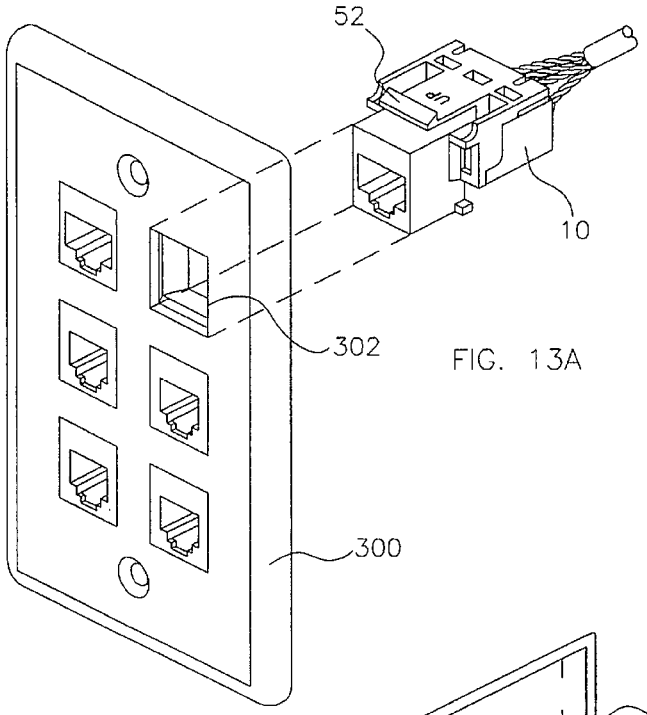
FIGS. 13A, 13B and 13C are front perspective, rear perspective and side views of a face plate installation of a jack assembly according to the present invention.
Figure 13B:
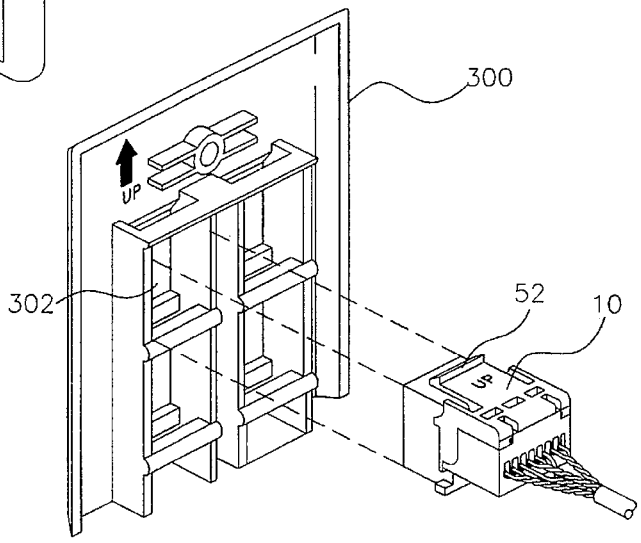
Figure 13C:
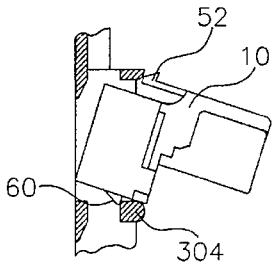

With reference to FIG. 13, the jack assembly 10 may be mounted to a face plate 300 by first inserting the bottom of the jack assembly into a jack opening 302 until the ramp 60 of the housing engages a mounting surface 304 of the face plate. The jack assembly 10 is then rotated and snapped into place due to deflection of the cantilever latch 52 of the housing.

Figure 14A:
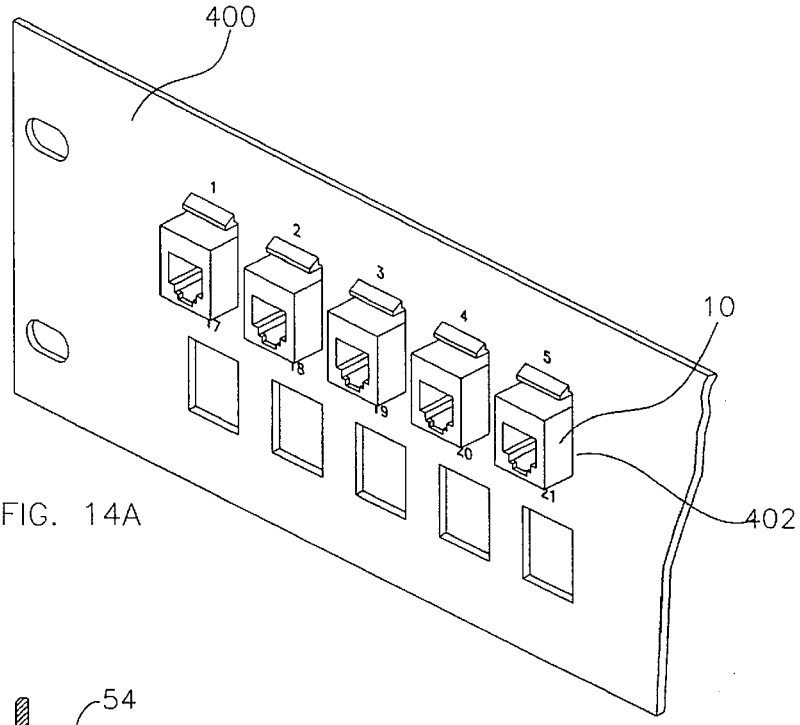
FIGS. 14A, 14B and 14C are front perspective, rear perspective and side views of a patch panel installation of a jack assembly according to the present invention.
Figure 14C:
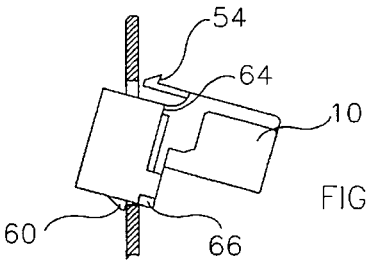
Figure 14B:
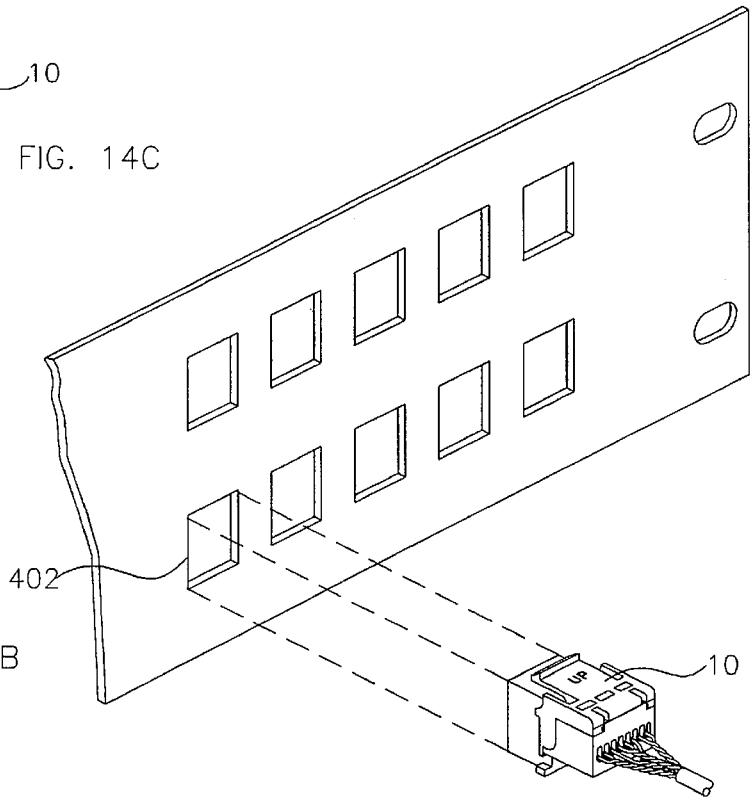

With reference to FIG. 14, the jack assembly 10 may be mounted to a patch panel 400. In this case, the bottom of the jack assembly is inserted into an opening 402 of the patch panel until the panel is captured between the ramp 60 and the depth restriction portion 66 of the housing. Then, the jack assembly is rotated and snapped into place similar to that described above with the patch panel also captured between the vertical bearing surface 54 of the cantilever latch and the depth restriction portion 64 of the housing.

Figure 15:
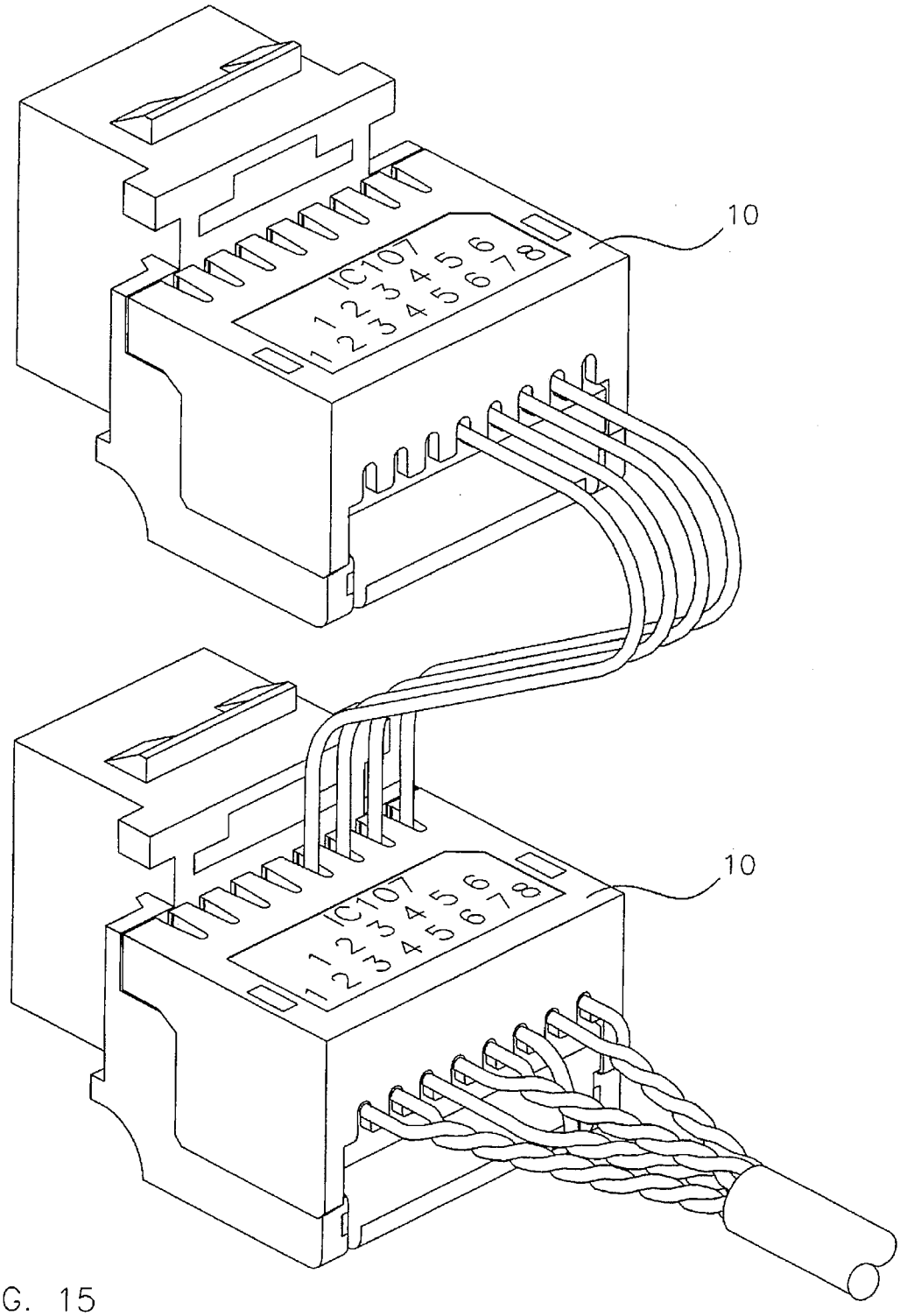
FIG. 15 is a perspective view of daisy chaining two jack assemblies according to present invention.

With reference to FIG. 15, an example of daisy chaining two jack assemblies 10 of the present invention is illustrated.

From the foregoing, it will be appreciated that the jack assembly of the present invention has a contact protection block incorporated into the mold of the insert. The protection block surrounds the insulation displacement portions of the contact pins with plastic material that renders the contact pins nearly impervious to accidental damage. The invention also permits the option of terminating telephone wires by hand or through the use of a punchdown tool. In either case, termination is readily accomplished with ease, efficiency and accuracy. The invention also provides an improved latching system that secures the termination cap to the rest of the assembly in a positive fashion without changing the overall width of the assembly. The latching system assures that parts of the invention will not separate unintentionally during installation or normal use.

While a particular form of the invention has been illustrated and described, it will be apparent that various modifications can be made without departing from the spirit and scope of the invention. For example, different latching mechanisms may be employed or, the termination cap may be latched to different portions of the insert assembly or to the housing. Accordingly, it is not intended that the invention may be limited except by the appended claims.

I claim:

1. A jack assembly for termination of a plurality of communication wires, the jack assembly comprising:

a housing having a front surface defining an opening for receiving a standard telephone plug;

a plurality of contact pins each having a first portion to conductively engage a corresponding terminal of the standard telephone plug and an insulation displacement portion to terminate a communication wire;

a contact pin carrier mounted to the housing and supporting the plurality of contact pins with their insulation displacement portions disposed rearwardly of the front surface of the housing and arranged upwardly in a single row transverse to the front surface opening;

the contact pin carrier further including a contact protection block formed around the insulation displacement portions of the plurality of contact pins the contact protection block having two outer side walls, one at each end of the single row of insulation displacement portions and an intermediate wall located between and extending above the insulation displacement portions of adjacent contact pins, the contact protection block defining a plurality of slots for receiving and guiding a plurality of communication wires, respectively, into conductive engagement with the insulation displacement portions of the contact pins;

a termination cap having communication wire engagement portions that secure the communication wires in conductive engagement with the insulation displacement portions of the contact pins when the termination cap is pushed down over the contact protection block to an assembled position, the termination cap further including two opposed end walls, each disposed in opposed alignment with and contiguous with a respective side wall of the contact protection block; and means for retaining the termination cap in the assembled position wherein the end walls of the termination cap form the exterior surface of the jack assembly at the outer side walls of the contact protection block.

2. The jack assembly of claim 1, wherein the plurality of contact pins includes a single row of eight contact pins additional intermediate walls of the single row of eight contact pins, such that one intermediate wall is located between and extending above the insulation displacement portions of each adjacent pair of contact pins, and the end walls and intermediate walls form the plurality of slots of the contact protection block including eight slots for receiving and guiding eight communication wires, respectively, into conductive engagement with the insulation displacement portions of the contact pins.

3. The jack assembly of claim 1, wherein the retaining means includes interlocking members on the termination cap and the contact pin carrier.

4. The jack assembly of claim 1, wherein the retaining means includes interlocking members on the termination cap and the contact protection block.

5. The jack assembly of claim 1, wherein the retaining means includes interlocking members on at least one of the side walls of the contact protection block and at least one of the end walls of the termination cap.

6. The jack assembly of claim 1, wherein the housing further comprises a rear surface and the contact protection block is spaced from the rear surface a sufficient distance to permit insertion therebetween of a termination tool for termination of the telephone wires.

7. The jack assembly of claim 1, wherein the retaining means includes interlocking members on the side walls of the contact protection block and on the corresponding end walls of the termination cap.

8. The jack assembly of claim 7, wherein the side walls of the contact protection block have channels and the corresponding end walls of the termination cap have inwardly directed latches that engage and are guided in the channels of the contact protection block during assembly of the termination cap onto the contact protection block.

9. The jack assembly of claim 7, wherein one of said termination cap and housing further comprises a guiding bar located forwardly of the interlocking members and the other of said termination cap and said housing further comprises a guiding channel for receiving and guiding the guiding bar during assembly of the termination cap onto the contact protection block.

10. A jack assembly for termination of a plurality of telephone wires, the jack assembly comprising:

a housing having a front surface defining an opening for receiving a standard telephone plug and a rear surface;

eight contact pins each having a first portion to conductively engage a corresponding terminal of the standard telephone plug and an insulation displacement portion to terminate a telephone wire;

a contact pin carrier mounted to the housing and supporting the eight contact pins with their insulation displacement portions disposed rearwardly of the front surface of the housing and arranged upwardly in a single row transverse to the front surface opening;

the contact pin carrier further including a contact protection block formed around the insulation displacement portions of the eight contact pins the contact protection block having two side walls, one at each end of the single row of insulation displacement portions and an intermediate wall located between and extending above the insulation displacement portions of adjacent contact pins, the end walls and intermediate walls of the contact protection block further defining eight slots for receiving and guiding eight telephone wires, respectively, into conductive engagement with the insulation displacement portions of the contact pins;

a termination cap having telephone wire engagement portions that secure the telephone wires in conductive engagement with the insulation displacement portions of the contact pins when the termination cap is pushed down over the contact protection block to an assembled position, the termination cap further including two opposed end walls, each disposed in opposed alignment with a respective side wall of the contact protection block; and interlocking members on the side walls of the contact protection block and on the corresponding end walls of the termination cap for retaining the termination cap in the assembled position;

wherein the contact protection block is spaced from the rear surface of the housing a sufficient distance to permit insertion therebetween of a termination tool for termination of the telephone wires; and wherein the termination cap forms the exterior surface of the jack assembly at the sides of the contact protection block.

* * * * *